US011618930B2

(12) United States Patent
Tsuneyoshi et al.

(10) Patent No.: US 11,618,930 B2
(45) Date of Patent: Apr. 4, 2023

(54) PERSONAL ORNAMENT AND METHOD FOR PRODUCING PERSONAL ORNAMENT

(71) Applicant: SEIKO WATCH KABUSHIKI KAISHA, Tokyo (JP)

(72) Inventors: Jun Tsuneyoshi, Chiba (JP); Yasunori Hara, Chiba (JP)

(73) Assignee: Seiko Watch Kabushiki Kaisha, Tokyo (JP)

( * ) Notice: Subject to any disclaimer, the term of this patent is extended or adjusted under 35 U.S.C. 154(b) by 145 days.

(21) Appl. No.: 17/124,793

(22) Filed: Dec. 17, 2020

(65) Prior Publication Data

US 2021/0198763 A1 Jul. 1, 2021

(30) Foreign Application Priority Data

Dec. 26, 2019 (JP) ..... JP2019-237176
Nov. 5, 2020 (JP) ..... JP2020-185320

(51) Int. Cl.

| | |
|---|---|
| ***C21D 9/00*** | (2006.01) |
| ***C21D 8/00*** | (2006.01) |
| ***C21D 6/00*** | (2006.01) |
| ***C22C 38/44*** | (2006.01) |
| ***C22C 38/04*** | (2006.01) |
| ***C22C 38/02*** | (2006.01) |
| ***C22C 38/00*** | (2006.01) |
| ***G04B 37/22*** | (2006.01) |
| *G04B 19/28* | (2006.01) |

(52) U.S. Cl.

CPC ..... *C21D 9/0068* (2013.01); *C21D 6/004* (2013.01); *C21D 6/005* (2013.01); *C21D 6/007* (2013.01); *C21D 6/008* (2013.01); *C21D 8/005* (2013.01); *C22C 38/001* (2013.01); *C22C 38/002* (2013.01); *C22C 38/02* (2013.01); *C22C 38/04* (2013.01); *C22C 38/44* (2013.01); *G04B 37/22* (2013.01); *C21D 2211/001* (2013.01); *G04B 19/283* (2013.01)

(58) Field of Classification Search

None

See application file for complete search history.

(56) References Cited

FOREIGN PATENT DOCUMENTS

| | | | |
|---|---|---|---|
| JP | 56102501 A | * | 8/1981 |
| JP | 2019-168407 A | | 10/2019 |

* cited by examiner

*Primary Examiner* — Anthony M Liang
(74) *Attorney, Agent, or Firm* — Crowell & Moring LLP

(57) ABSTRACT

A personal ornament has excellent corrosion resistance, in which predetermined chemical components are included, the remainder includes Fe and impurities, a structure contains austenite at 95% or more in area %, when a diameter of a circle having a smallest area capable of including one intermetallic compound inside is defined as a size of the intermetallic compound, the number of intermetallic compounds in which the size of the intermetallic compound is 150 μm or more is 0, and the number of intermetallic compounds in which the size is 13 μm or more and less than 150 μm is 3 or less, an average equivalent circle diameter of the austenite is 150 μm or less, and a PRE defined by the following formula (1) is 40 or more.

$$PRE=[Cr]+3.3[Mo]+16[N] \quad (1)$$

3 Claims, 1 Drawing Sheet

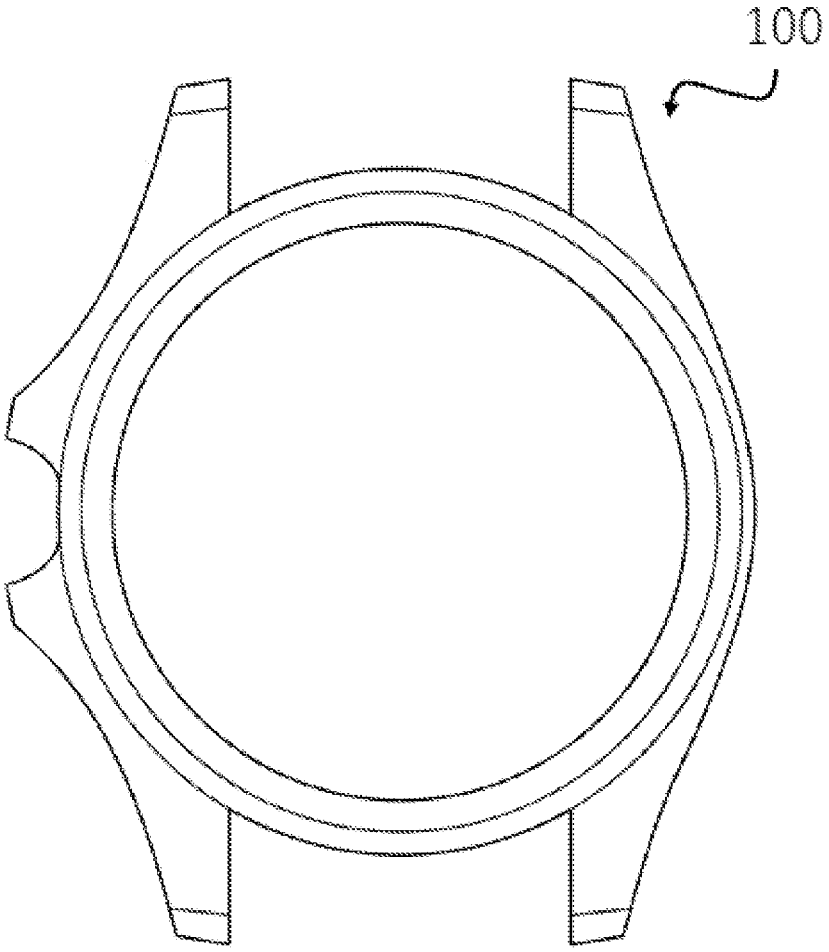
100

PERSONAL ORNAMENT AND METHOD FOR PRODUCING PERSONAL ORNAMENT

RELATED APPLICATIONS

This application claims priority to Japanese Patent Application No. 2019-237176, filed on Dec. 26, 2019, and Japanese Patent Application No. 2020-185320, filed on Nov. 5, 2020, the entire contents of which are incorporated herein by reference.

BACKGROUND OF THE INVENTION

1. Field of the Invention

Embodiments of the present invention relate to a personal ornament and a method for producing a personal ornament.

2. Description of the Related Art

Recently, as personal ornaments to be worn such as watches, necklaces, broaches, and earrings, there are, for example, those using stainless steel as described in Patent Document 1 (JP-A-2019-168407).

On the other hand, the demand for corrosion resistance in personal ornaments has grown more and more.

As a method for improving the corrosion resistance of a personal ornament, there is a method for producing a personal ornament with a material containing Cr and Mo in large amounts. On the other hand, when a personal ornament is produced with a material containing Cr and Mo in large amounts, in a cross section of the material containing Cr and Mo in large amounts, a compound with high Cr and Mo contents remains. The compound with high Cr and Mo contents is a different phase from the parent phase, and therefore had a problem that the specularity of the personal ornament is deteriorated. Further, the compound with high Cr and Mo contents decreases the Cr and Mo contents of the parent phase, and therefore had a problem that the corrosion resistance of the personal ornament is deteriorated.

SUMMARY OF THE INVENTION

Embodiments of the present invention have been made in order to solve the above-mentioned problems, and have its object to provide a personal ornament having excellent corrosion resistance and specularity and a method for producing the personal ornament.

(1) A personal ornament in which chemical components include, in mass %:

C: 0.10% or less;
Si: 1.5% or less;
Mn: 1.5% or less;
P: 0.050% or less;
S: 0.050% or less;
O: 0.020% or less;
Ni: 15.0 to 38.0%;
Cr: 17.0 to 27.0%;
Mo: 4.0 to 8.0%;
Cu: 3.0% or less; and
N: 0.55% or less, the remainder includes Fe and impurities, a structure contains austenite at 95% or more in area %, when a diameter of a circle having a smallest area capable of including one intermetallic compound inside is defined as a size of the intermetallic compound, on an exposed surface of the personal ornament, the number of intermetallic compounds in which the size is 150 μm or more is 0, and the number of intermetallic compounds in which the size is 13 μm or more and less than 150 μm is 3 or less, an average equivalent circle diameter of the austenite is 150 μm or less, and a PRE defined by the following formula (1) is 40 or more:

$$PRE=[Cr]+3.3[Mo]+16[N] \quad (1)$$

wherein [Cr], [Mo], and [N] denote the contents in mass % of Cr, Mo, and N in a component composition of the personal ornament, and 0 is substituted when such a component is not contained.

(2) The personal ornament according to (1), in which the chemical components further include, in mass %, one type or two or more types selected from:

Al: 0.001 to 0.10%;
Co: 0.001 to 3.0%;
W: 0.001 to 8.0%;
Ta: 0.001 to 1.0%;
Sn: 0.001 to 1.0%;
Sb: 0.001 to 1.0%;
Ga: 0.001 to 1.0%;
Ti: 0.001 to 1.0%;
V: 0.001 to 1.0%;
Nb: 0.001 to 1.0%;
Zr: 0.001 to 1.0%;
Te: 0.001 to 1.0%;
Se: 0.001 to 1.0%;
B: 0.0001 to 0.01%
Ca: 0.0001 to 0.05%;
Mg: 0.0001 to 0.05%; and
a rare earth element: 0.001 to 1.0%.

(3) The personal ornament according to (1) or (2), in which the personal ornament is a timepiece exterior.

(4) A method for producing the personal ornament according to any one of (1) to (3), including: a step of producing a plate material; a heat treatment step of subjecting the plate material to a heat treatment; and a cold rolling step of subjecting the plate material to plastic working, wherein in the heat treatment step, a heat treatment temperature is 1350 to 1600 K, and a heat treatment time satisfies the following formula (2), and in the cold rolling step, a rolling reduction ratio is 7 to 50%:

$$t_{dif} \geq (6869/T_{dif}-4.3326)\times\lambda^2 \quad (2)$$

wherein $T_{dif}$ represents the heat treatment temperature (K), $t_{dif}$ represents the heat treatment time (hour), and λ represents a plate thickness (mm) of the plate material.

(5) A method for producing the personal ornament according to any one of (1) to (3), including: a step of producing a bar material; a heat treatment step of subjecting the bar material to a heat treatment; and a cold drawing step of subjecting the bar material to plastic working, wherein in the heat treatment step, a heat treatment temperature is 1350 to 1600 K, and a heat treatment time satisfies the following formula (3), and in the cold drawing step, an area reduction ratio is 7 to 50%:

$$t_{dif} \geq (6869/T_{dif}-4.3326)\times d \quad (3)$$

wherein $T_{dif}$ represents the heat treatment temperature (K), $t_{dif}$ represents the heat treatment time (hour), and d represents an equivalent circle diameter (mm) of the bar material.

(6) A method for producing the personal ornament according to any one of (1) to (3), including: a step of producing a plate material or a bar material; a heat treatment step of subjecting the plate material or the bar material to a heat treatment; a hot forging step of subjecting the plate material or the bar material to hot forging; and a cold forging step of subjecting the plate material or the bar material to cold forging, wherein in the heat treatment step, a heat treatment temperature is 1350 to 1600 K, in the case of the plate material, a heat treatment time satisfies the following formula (2), and in the case of the bar material, a heat treatment time satisfies the following formula (3):

$$t_{dif} \geq (6869/T_{dif} - 4.3326) \times \lambda^2 \quad (2)$$

$$t_{dif} \geq (6869/T_{dif} - 4.3326) \times d \quad (3)$$

wherein in the formula (2), $T_{dif}$ represents the heat treatment temperature (K), $t_{dif}$ represents the heat treatment time (hour), and $\lambda$ represents a plate thickness (mm) of the plate material, and in the formula (3), $T_{dif}$ represents the heat treatment temperature (K), $t_{dif}$ represents the heat treatment time (hour), and d represents an equivalent circle diameter (mm) of the bar material.

BRIEF DESCRIPTION OF THE DRAWINGS

FIGURE is an external view of a personal ornament according to an embodiment of the present invention.

DETAILED DESCRIPTION OF THE PREFERRED EMBODIMENTS

The present inventor conducted various studies for improving the corrosion resistance and specularity of a personal ornament, and as a result, obtained the following findings.

In a cross section of a commercially available material having a PRE of 40 or more, an intermetallic compound is present in a large amount. Here, the intermetallic compound is an intermetallic compound with higher Cr and Mo contents than the Cr and Mo contents of the parent phase.

When the material containing an intermetallic compound in a large amount and having a PRE of 40 or more is polished, the intermetallic compound appears as a heterogeneous phase, and a mirror face applicable to a personal ornament cannot be obtained. Further, the intermetallic compound decreases the Cr and Mo contents of the parent phase, and therefore, excellent corrosion resistance cannot be exhibited at an exposed face of the intermetallic compound.

The present invention has been achieved as a result of studies described above, and hereinafter, with respect to embodiments according to the present invention, the reason for limiting characteristic technical requirements and preferred aspects will be sequentially described. First, a personal ornament according to one embodiment of the present invention will be described. The personal ornament described below is a timepiece exterior 100 which is shown in FIG. 1.

(Component Composition of Personal Ornament)

Chemical components contained in the personal ornament according to one embodiment of the present invention (hereinafter sometimes abbreviated as "personal ornament") and the reason for limiting the contents of the respective components will be described. Note that in the following description, "%" denotes "mass %" unless otherwise specified.

C: 0.10% or Less

A C content needs to be set to 0.10% or less. When the C content exceeds 0.10%, Cr carbide is excessively formed, and the corrosion resistance of the personal ornament is deteriorated. The upper limit of the C content is preferably 0.08% or less, more preferably 0.05% or less. On the other hand, C is an element that forms austenite, and therefore may be contained. The lower limit of the C content is preferably 0.005% or more, more preferably 0.010% or more.

Si: 1.5% or Less

An Si content needs to be set to 1.5% or less. When the Si content exceeds 1.5%, deposition of an intermetallic compound is promoted, and the corrosion resistance and specularity of the personal ornament are deteriorated. The upper limit of the Si content is preferably 1.0% or less, more preferably 0.6% or less. On the other hand, Si is an element having a deoxidation effect, and therefore may be contained. The lower limit of the Si content is preferably 0.10% or more, more preferably 0.30% or more.

Mn: 1.5% or Less

An Mn content needs to be set to 1.5% or less. When the Mn content exceeds 1.5%, the corrosion resistance of the personal ornament is deteriorated. The upper limit of the Mn content is preferably 1.0% or less, more preferably 0.8% or less. On the other hand, Mn is an element that forms austenite and an element having a deoxidation effect, and therefore may be contained. The lower limit of the Mn content is preferably 0.01% or more, more preferably 0.10% or more.

P: 0.050% or Less

A P content needs to be suppressed to 0.050% or less. When the P content exceeds 0.050%, the toughness of the personal ornament is deteriorated. The upper limit of the P content is preferably 0.045% or less, more preferably 0.035% or less.

S: 0.050% or Less

An S content needs to be suppressed to 0.050% or less. When the S content exceeds 0.050%, the toughness and corrosion resistance of the personal ornament are deteriorated. The upper limit of the S content is preferably 0.040% or less, more preferably 0.015% or less.

O: 0.020% or Less

An O content needs to be suppressed to 0.020% or less. When the O content exceeds 0.020%, the toughness of the personal ornament is deteriorated. The upper limit of the O content is preferably 0.015% or less, more preferably 0.010% or less.

Ni: 15.0 to 38.0%

An Ni content needs to be set to 15.0 to 38.0%. When the Ni content is less than 15.0%, ferrite is excessively formed, and the toughness and corrosion resistance of the personal ornament are deteriorated. The lower limit of the Ni content is preferably 17.0% or more, more preferably 18.0% or more. On the other hand, when the Ni content exceeds 38.0%, the effect of improving the corrosion resistance of the personal ornament is saturated. Further, the Ni content becomes excessively large, and the price of the personal ornament becomes high. The upper limit of the Ni content is preferably 30.0% or less, more preferably 20.0% or less.

Cr: 17.0 to 27.0%

A Cr content needs to be set to 17.0 to 27.0%. When the Cr content is less than 17.0%, the corrosion resistance of the personal ornament is deteriorated. The lower limit of the Cr content is preferably 18.0% or more, more preferably 19.0% or more. On the other hand, when the Cr content exceeds 27.0%, ferrite and an intermetallic compound are excessively formed, and the toughness and corrosion resistance of the personal ornament are deteriorated. The upper limit of the Cr content is preferably 25.0% or less, more preferably 21.0% or less.

Mo: 4.0 to 8.0%

An Mo content needs to be set to 4.0 to 8.0%. When the Mo content is less than 4.0%, the corrosion resistance of the personal ornament is deteriorated. The lower limit of the Mo content is preferably 5.0% or more, more preferably 6.0% or more. On the other hand, when the Mo content exceeds 8.0%, ferrite and an intermetallic compound are excessively formed, and the toughness and corrosion resistance of the personal ornament are deteriorated. The upper limit of the Mo content is preferably 7.5% or less, more preferably 7.0% or less.

Cu: 3.0% or Less

A Cu content needs to be set to 3.0% or less. When the Cu content exceeds 3.0%, a crack is likely to occur during casting. The upper limit of the Cu content is preferably 1.0% or less, more preferably 0.8% or less. On the other hand, Cu has an effect of suppressing the progress of corrosion when corrosion has occurred, and therefore may be contained. The lower limit of the Cu content is preferably 0.01% or more, more preferably 0.10% or more.

N: 0.55% or Less

An N content needs to be set to 0.55% or less. When the N content exceeds 0.55%, a crack is likely to occur during casting. The upper limit of the N content is preferably 0.50% or less, more preferably 0.35% or less, further more preferably 0.25% or less. On the other hand, N has an effect of improving corrosion resistance and an effect of forming austenite, and therefore may be contained. The lower limit of the N content is preferably 0.05% or more, more preferably 0.10% or more, further more preferably 0.15% or more.

PRE is 40 or More

A PRE defined by the following formula (1) needs to be 40 or more. When the PRE is less than 40, the corrosion resistance of the personal ornament is deteriorated.

$$PRE=[Cr]+3.3[Mo]+16[N] \quad (1)$$

Note that [Cr], [Mo], and [N] in the formula (1) denote the contents in mass % of Cr, Mo, and N in a component composition of the personal ornament, and 0 is substituted when such a component is not contained.

The personal ornament according to this embodiment may further contain, in mass %, one type or two or more types selected from Al, Co, W, Ta, Sn, Sb, Ga, Ti, V, Nb, Zr, Te, Se, B, Ca, Mg, and a rare earth element other than the above-mentioned elements. Note that these elements need not be contained, and therefore, the lower limit of the content is 0.

Al: 0.10% or Less

The personal ornament according to this embodiment may contain Al at 0.10% or less. Al is an element having a deoxidation effect, and therefore may be contained. The content thereof when Al is contained for obtaining this effect is 0.001% or more, more preferably 0.005% or more. On the other hand, when the Al content exceeds 0.10%, Al nitride or Al oxide is excessively formed, and the corrosion resistance and toughness of the personal ornament is deteriorated. The upper limit of the Al content is preferably 0.05% or less, more preferably 0.02% or less.

Co: 3.0% or Less

The personal ornament according to this embodiment may contain Co at 3.0% or less. Co forms austenite and has an effect of suppressing the formation of an intermetallic compound, and therefore may be contained. The content thereof when Co is contained for obtaining this effect is 0.001% or more, more preferably 0.1% or more. On the other hand, when the Co content exceeds 3.0%, the workability is deteriorated. The upper limit of the Co content is preferably 2.0% or less, more preferably 1.5% or less.

W: 8.0% or Less

The personal ornament according to this embodiment may contain W at 8.0% or less. W has an effect of improving corrosion resistance, and therefore may be contained. The content thereof when W is contained for obtaining this effect is 0.001% or more, more preferably 0.1% or more. On the other hand, when the W content exceeds 8.0%, the workability is deteriorated. The upper limit of the W content is preferably 5.0% or less, more preferably 1.0% or less.

Ta: 1.0% or Less

The personal ornament according to this embodiment may contain Ta at 1.0% or less. Ta has an effect of refining crystal grains and an effect of improving corrosion resistance, and therefore may be contained. The content thereof when Ta is contained for obtaining these effects is 0.001% or more, more preferably 0.005% or more. On the other hand, when the Ta content exceeds 1.0%, the workability is deteriorated. The upper limit of the Ta content is preferably 0.5% or less, more preferably 0.1% or less.

Sn: 1.0% or Less

The personal ornament according to this embodiment may contain Sn at 1.0% or less. Sn has an effect of improving corrosion resistance, and therefore may be contained. The content thereof when Sn is contained for obtaining this effect is 0.001% or more, more preferably 0.005% or more. On the other hand, when the Sn content exceeds 1.0%, the workability is deteriorated. The upper limit of the Sn content is preferably 0.5% or less, more preferably 0.3% or less.

Sb: 1.0% or Less

The personal ornament according to this embodiment may contain Sb at 1.0% or less. Sb has an effect of improving corrosion resistance, and therefore may be contained. The content thereof when Sb is contained for obtaining this effect is 0.001% or more, more preferably 0.005% or more. On the other hand, when the Sb content exceeds 1.0%, the workability is deteriorated. The upper limit of the Sb content is preferably 0.5% or less, more preferably 0.3% or less.

Ga: 1.0% or Less

The personal ornament according to this embodiment may contain Ga at 1.0% or less. Ga has an effect of improving corrosion resistance and an effect of improving workability, and therefore may be contained. The content thereof when Ga is contained for obtaining these effects is 0.001% or more, more preferably 0.015% or more. On the other hand, when the Ga content exceeds 1.0%, the effect of improving corrosion resistance and the effect of improving workability are saturated. The upper limit of the Ga content is preferably 0.5% or less, more preferably 0.3% or less.

Ti: 1.0% or Less

The personal ornament according to this embodiment may contain Ti at 1.0% or less. Ti has an effect of improving corrosion resistance by fixing C and N as a carbonitride and an effect of refining crystal grains, and therefore may be contained. The content thereof when Ti is contained for obtaining these effects is 0.001% or more, more preferably 0.01% or more. On the other hand, when the Ti content exceeds 1.0%, excessive amounts of an oxide and a nitride are formed, and the workability is deteriorated. The upper limit of the Ti content is preferably 0.5% or less, more preferably 0.3% or less.

V: 1.0% or Less

The personal ornament according to this embodiment may contain V at 1.0% or less. V has an effect of improving corrosion resistance by fixing C and N as a carbonitride and an effect of refining crystal grains, and therefore may be contained. The content thereof when V is contained for obtaining these effects is 0.001% or more, more preferably 0.02% or more. On the other hand, when the V content exceeds 1.0%, excessive amounts of an oxide and a nitride are formed, and the workability is deteriorated. The upper limit of the V content is preferably 0.9% or less, more preferably 0.5% or less.

Nb: 1.0% or Less

The personal ornament according to this embodiment may contain Nb at 1.0% or less. Nb has an effect of improving corrosion resistance by fixing C and N as a carbonitride and an effect of refining crystal grains, and therefore may be contained. The content thereof when Nb is contained for obtaining these effects is 0.001% or more, more preferably 0.02% or more. On the other hand, when the Nb content exceeds 1.0%, excessive amounts of an oxide and a nitride are formed, and the workability is deteriorated. The upper limit of the Nb content is preferably 0.5% or less, more preferably 0.2% or less.

Zr: 1.0% or Less

The personal ornament according to this embodiment may contain Zr at 1.0% or less. Zr has an effect of improving strength and an effect of refining crystal grains, and therefore may be contained. The content thereof when Zr is contained for obtaining these effects is 0.001% or more, more preferably 0.02% or more. On the other hand, when the Zr content exceeds 1.0%, the workability is deteriorated. The upper limit of the Zr content is preferably 0.5% or less, more preferably 0.2% or less.

Te: 1.0% or Less

The personal ornament according to this embodiment may contain Te at 1.0% or less. Te has an effect of improving machinability, and therefore may be contained. The content thereof when Te is contained for obtaining this effect is 0.001% or more, more preferably 0.01% or more. On the other hand, when the Te content exceeds 1.0%, the corrosion resistance is deteriorated. The upper limit of the Te content is preferably 0.05% or less, more preferably 0.02% or less.

Se: 1.0% or Less

The personal ornament according to this embodiment may contain Se at 1.0% or less. Se has an effect of improving machinability, and therefore may be contained. The content thereof when Se is contained for obtaining this effect is 0.001% or more, more preferably 0.01% or more. On the other hand, when the Se content exceeds 1.0%, the corrosion resistance is deteriorated. The upper limit of the Se content is preferably 0.2% or less, more preferably 0.1% or less.

B: 0.01% or Less

The personal ornament according to this embodiment may contain B at 0.01% or less. B has an effect of improving hot workability, and therefore may be contained. The content thereof when B is contained for obtaining this effect is 0.0001% or more, more preferably 0.0005% or more. On the other hand, when the B content exceeds 0.01%, the corrosion resistance is deteriorated. The upper limit of the B content is preferably 0.005% or less, more preferably 0.003% or less.

Ca: 0.05% or Less

The personal ornament according to this embodiment may contain Ca at 0.05% or less. Ca has an effect of improving hot workability, and therefore may be contained. The content thereof when Ca is contained for obtaining this effect is 0.0001% or more, more preferably 0.0005% or more. On the other hand, when the Ca content exceeds 0.05%, the hot workability is deteriorated instead. The upper limit of the Ca content is preferably 0.005% or less, more preferably 0.003% or less.

Mg: 0.05% or Less

The personal ornament according to this embodiment may contain Mg at 0.05% or less. Mg has an effect of improving hot workability, and therefore may be contained. The content thereof when Mg is contained for obtaining this effect is 0.0001% or more, more preferably 0.0005% or more. On the other hand, when the Mg content exceeds 0.05%, the hot workability is deteriorated instead. The upper limit of the Mg content is preferably 0.005% or less, more preferably 0.003% or less.

Rare Earth Element: 1.0% or Less

The personal ornament according to this embodiment may contain a rare earth element at 1.0% or less. The rare earth element has an effect of improving hot workability, and therefore may be contained. The content thereof when the rare earth element is contained for obtaining this effect is 0.001% or more, more preferably 0.005% or more. On the other hand, when the rare earth element content exceeds 1.0%, the hot workability is deteriorated instead. The upper limit of the rare earth element content is preferably 0.1% or less, more preferably 0.03% or less.

Remainder Including Fe and Impurities

The remainder other than the elements described above includes Fe and impurities. Further, an element other than the respective elements described above can be contained within a range not impairing the effect of this embodiment. The remainder other than the elements described above is preferably composed of Fe and impurities.

A measurement method for the component composition of the personal ornament is as follows. As for an element other than O and N, first, in the case of a plate material, a sample is collected from the ¼ thickness of the plate, and in the case of a bar material, a sample is collected from the ½ length of a line segment connecting the surface and the center. Thereafter, the component composition is measured according to JIS G 1256: 2013 (iron and steel—Methods for X-ray fluorescence spectrometric analysis).

Further, O is measured for the above-mentioned sample using JIS G 1239: 2014 (Infrared absorption method after fusion under inert gas). N is measured for the above-mentioned sample using JIS G 1228: 2006 (Iron and steel—Methods for determination of nitrogen content).

The shape of the plate material is in accordance with the specification in JIS G 4304: 2012 (Hot-rolled stainless steel plate, sheet and strip) or JIS G 4305: 2012 (Cold-rolled stainless steel plate, sheet and strip).

Further, the shape of the bar material is in accordance with the specification in JIS G 4303: 2012 (Stainless steel bars).

(Structure of Personal Ornament)

The reason for limiting the structure of the personal ornament according to one embodiment of the present invention will be described. Note that in the following description, "%" denotes "area %" unless otherwise specified.

Austenite Contained at 95% or More

Austenite needs to be contained at 95% or more. When the austenite is contained at less than 95%, the amount of the intermetallic compound becomes excessively large, and the specularity and corrosion resistance of the personal ornament are deteriorated. The austenite is contained at preferably 97% or more, more preferably 98% or more, further more preferably 99% or more.

When a heat treatment of the present invention is performed, a crystal defect observed in usual annealing is recovered or a characteristic structure occurs other than formation of an annealing twin. For example, a primarily recrystallized austenite crystal grain that corrodes an old austenite crystal grain including a twin is observed. Further, depending on the heat treatment conditions, a secondarily recrystallized coarse austenite crystal grain is sometimes also observed. Such a structure can be confirmed using an electron backscatter diffraction (EBSD) device attached to an electron microscope.

A measurement method for the area % of the austenite is as follows. First, it is performed using a scanning electron microscope-backscattered electron image (SEM-BSE). As for the measurement magnification, the measurement is performed with a magnification so that a square with a side of about 710 μm is included in the field of view, which is the same as a standard diagram described in JIS G 0555, Microscopic testing method for the non-metallic inclusions in steel (2003).

As for the measurement site, in the case of a plate material, the observation is performed at a position where a central portion of the plate thickness is parallel to one side (about 710 μm) of the square field of view and passes through the center of the square. In the case of a bar material, the observation is performed at a position where the center of the cross section perpendicular to the longitudinal direction becomes the center of the square field of view. In the plate material and the bar material, an intermetallic compound with high Cr and Mo contents is present in the largest amount at the above-mentioned observation sites. On the exposed surface of the personal ornament, the area fraction of the austenite is higher and the area fraction of the intermetallic compound is lower than at the above-mentioned observation sites.

In the backscattered electron image, with respect to the contrast of the parent phase that is the austenite, the intermetallic compound with high Cr and Mo contents is looked bright (white), and a non-metallic inclusion is looked dark (black). When a captured image display exists, the measurement site is adjusted so that a portion where compounds other than the austenite gather together is located at the center of the above-mentioned square.

Subsequently, a captured backscattered electron image photograph is subjected to an image analysis and is classified into three stages of luminance pixels: an intermetallic compound (high-luminance pixel), austenite (intermediate-luminance pixel), and a non-intermetallic compound (low-luminance pixel). The percentage of the number of pixels of the austenite with respect to the total number of pixels is determined to be the area % of the austenite.

On the exposed surface of the personal ornament, the number of intermetallic compounds in which the size is 150 μm or more is 0, and the number of intermetallic compounds in which the size is 13 μm or more and less than 150 μm is 3 or less.

In the personal ornament according to this embodiment, on the exposed surface of the personal ornament, the number of intermetallic compounds in which the size is 150 μm or more needs to be 0. When the number of intermetallic compounds in which the size is 150 μm or more exceeds 0, the specularity and corrosion resistance of the personal ornament are deteriorated. The size of the intermetallic compound is a diameter of a circle having a smallest area capable of including one intermetallic compound inside. The phrase "on the exposed surface of the personal ornament" refers to the surface of the personal ornament for which the appearance can be observed.

Further, in the personal ornament according to this embodiment, on the exposed surface of the personal ornament, the number of intermetallic compounds in which the size is 13 μm or more and less than 150 μm needs to be 3 or less. When the number of intermetallic compounds in which the size is 13 μm or more and less than 150 μm exceeds 3, the specularity and corrosion resistance of the personal ornament are deteriorated.

The intermetallic compound is a different phase from the austenite that is the parent phase, and therefore, the intermetallic compound and the austenite have different appearances. Due to this, when the number of intermetallic compounds is excessively large, sufficient specularity applicable to a personal ornament cannot be obtained.

Further, a region where the Cr and Mo contents are excessively small is formed on the parent phase side at the interface between the intermetallic compound and the austenite that is the parent phase. Therefore, when the number of intermetallic compounds is excessively large, the corrosion resistance of the personal ornament is deteriorated.

A measurement method for the number of intermetallic compounds in which the size is 150 μm or more and intermetallic compounds in which the size is 13 μm or more and less than 150 μm is as follows. First, by using an optical microscope, a photograph of a structure of the exposed surface of the personal ornament is captured with a magnification of 10 times. In the captured photograph, the size of the intermetallic compound is measured. The size of the intermetallic compound is a diameter of a circle having a smallest area capable of including one intermetallic compound inside. Then, the number of intermetallic compounds in which the size is 150 μm or more and intermetallic compounds in which the size is 13 μm or more and less than 150 μm is counted.

Average equivalent circle diameter of austenite is 150 μm or less. An average equivalent circle diameter of the austenite needs to be 150 μm or less.

An average equivalent circle diameter of the austenite needs to be 150 μm or less. When the average equivalent circle diameter of the austenite exceeds 150 μm, the specularity of the personal ornament is deteriorated. The average equivalent circle diameter of the austenite is preferably 70 μm or less.

A measurement method for the average equivalent circle diameter of the austenite is as follows. An azimuth of an individual crystal grain is determined using an electron backscatter diffraction device (EBSD device) attached to a field-emission type SEM. A site where an azimuth difference between adjacent pixels is 5° or more is defined as a crystal grain boundary. Further, the actual area of a crystal grain is measured, and the average equivalent circle diameter of the austenite is calculated from the formula for determining the area of a circle. Note that processing in which an annealing twin present in a crystal grain is not determined to be the grain boundary is performed.

Remainder Other than Intermetallic Compound and Austenite

The remainder other than the intermetallic compound and the austenite may include non-metallic phases such as an inclusion, an oxide, a nitride, and a carbide.

Examples of the personal ornament according to this embodiment include, but are not limited to, a timepiece exterior, a necklace, and eye glasses. Here, examples of the timepiece exterior include, but are not limited to, a case and a belt for a timepiece, and a case and a belt for a wearable instrument having a function of a timepiece.

Next, a method for producing a personal ornament according to one embodiment of the present invention will be described. Note that since the production method is different between a case where a plate material is used and a case where a bar material is used, and therefore, the case where a plate material is used and the case where a bar material is used will be described separately.

The method for producing a personal ornament according to one embodiment of the present invention includes a step of producing a plate material having the above-mentioned chemical components, a heat treatment step of subjecting the plate material to a heat treatment, and a cold rolling step of subjecting the plate material to plastic working.

(Step of Producing Plate Material)

In the step of producing a plate material, a known method can be used. In the step of producing a plate material, although not particularly limited, for example, a method as described below can be adopted. In a melting furnace such as an electric furnace capable of applying a pressure or a high-frequency induction furnace capable of applying a pressure, an alloy having the above-mentioned chemical composition is melted and casted into a steel ingot. Subsequently, the obtained steel ingot is hot-worked to form a plate material having a desired shape. Then, after the hot working, a solid-solution heat treatment is performed.

(Heat Treatment Step)

In the heat treatment step, a heat treatment temperature needs to be 1350 to 1600 K. When the heat treatment temperature is lower than 1350 K, the corrosion resistance and specularity of the personal ornament are deteriorated. The heat treatment temperature is preferably 1473 K or higher. On the other hand, when the heat treatment temperature exceeds 1600 K, high-temperature deformation due to its own weight of the material or partial melting occurs. The heat treatment temperature is preferably 1548 K or lower.

In the heat treatment step, a heat treatment time needs to satisfy the following formula (2).

$$t_{dif} \geq (6869/T_{dif} - 4.3326) \times \lambda^2 \quad (2)$$

Note that in the formula (2), $T_{dif}$ represents the heat treatment temperature (K), $t_{dif}$ represents the heat treatment time (hour), and λ represents a plate thickness (mm) of the plate material. When the heat treatment time does not satisfy the formula (2), the amount of the intermetallic compound becomes excessively large, and the corrosion resistance and specularity of the personal ornament are deteriorated.

A heat treatment method may be heating in inert gas ambient below atmospheric pressure. By heating in inert gas ambient, sublimation of Cr during the heat treatment is suppressed, and the corrosion resistance of the personal ornament is further improved.

After the heat treatment step, cooling at 60° C./min or more may be performed. By performing cooling at 60° C./min or more, redeposition of the intermetallic compound or an increase in the content thereof is further suppressed, and the corrosion resistance and specularity of the personal ornament are further improved.

(Cold Rolling Step)

In the cold rolling step, a rolling reduction ratio needs to be 7 to 50%. When the rolling reduction ratio is less than 7%, the average equivalent circle diameter of the austenite becomes excessively large, and the specularity of the personal ornament is deteriorated. The rolling reduction ratio is preferably 13% or more. On the other hand, when the rolling reduction ratio exceeds 50%, the hardness of the material becomes excessively high. As a result, the machinability or pressability of the material is deteriorated.

(Hot Forging Step and Cold Forging Step)

The method for producing a personal ornament according to one embodiment of the present invention may include a hot forging step of performing hot plastic deformation by heating the plate material to a temperature in a range where the austenite is stable and a cold forging step of performing cold plastic deformation by omitting the above-mentioned cold rolling step. The amount of plastic deformation in the hot forging step and the cold forging step is not particularly limited as long as the average equivalent circle diameter of the austenite on the exposed surface of the personal ornament is 150 μm or less. The amount of plastic deformation in the hot forging step and the cold forging step is preferably selected so that the average equivalent circle diameter of the austenite on the exposed surface of the personal ornament is 70 μm or less. The hot forging step and the cold forging step tend to increase the material yield as compared with the cold rolling step. Therefore, it is preferred to perform the hot forging step and the cold forging step by omitting the cold rolling step.

Next, a method for producing a personal ornament according to another embodiment of the present invention will be described.

The method for producing a personal ornament according to another embodiment of the present invention includes a step of producing a bar material having a chemical composition described in the above-mentioned embodiment, a heat treatment step of subjecting the bar material to a heat treatment, and a cold drawing step of subjecting the bar material to plastic working.

(Step of Producing Bar Material)

In the step of producing a bar material, a known method can be used.

(Heat Treatment Step)

In the heat treatment step, a heat treatment temperature needs to be 1350 to 1600 K. When the heat treatment temperature is lower than 1350 K, the amount of the intermetallic compound becomes excessively large, and the corrosion resistance and specularity of the personal ornament are deteriorated. The heat treatment temperature is preferably 1473 K or higher. On the other hand, when the heat treatment temperature exceeds 1600 K, high-temperature deformation due to its own weight of the material or partial melting occurs. The heat treatment temperature is preferably 1548 K or lower.

In the heat treatment step, a heat treatment time needs to satisfy the following formula (3).

$$t_{dif} \geq (6869/T_{dif} - 4.3326) \times d \quad (3)$$

Note that in the formula (3), $T_{dif}$ represents the heat treatment temperature (K), $t_{dif}$ represents the heat treatment time (hour), and d represents an equivalent circle diameter (mm) of the bar material. When the heat treatment time does not satisfy the formula (3), the amount of the intermetallic compound becomes excessively large, and the corrosion resistance and specularity of the personal ornament are deteriorated.

The concentration diffusion of Cr or Mo during the heat treatment of the intermetallic compound with high Cr and Mo contents one-dimensionally proceeds to both sides in the rolling direction from the center plane in the thickness direction in the plate material, and two-dimensionally proceeds to the circumferential side face from the central axis in the wire drawing direction in the bar material.

In the formula (2) with respect to the heat treatment time for the plate material, a time for which the diffusion amount from the intermetallic compound with high Cr and Mo contents to the peripheral austenite becomes equivalent in the plate material and in the bar material is assumed. Then, in the bar material used for the personal ornament, the formula (3) is derived by substituting the plate thickness $\lambda^2$ with the diameter d.

As the conditions other than the heat treatment temperature and the heat treatment time, the conditions described in the method for producing a personal ornament according to the above-mentioned embodiment can be adopted.

(Cold Drawing Step)

In the cold drawing step, an area reduction ratio needs to be 7 to 50%. When the area reduction ratio is less than 7%, the average equivalent circle diameter of the austenite becomes excessively large, and the specularity of the personal ornament is deteriorated. The area reduction ratio is preferably 13% or more. On the other hand, when the area reduction ratio exceeds 50%, the hardness of the material becomes excessively high. As a result, the machinability or pressability of the material is deteriorated.

As the conditions other than the area reduction ratio, the conditions described in the method for producing a personal ornament according to the above-mentioned embodiment can be adopted.

(Hot Forging Step and Cold Forging Step)

The method for producing a personal ornament according to another embodiment of the present invention may include a hot forging step of performing hot plastic deformation by heating the bar material to a temperature in a range where the austenite is stable and a cold forging step of performing cold plastic deformation by omitting the above-mentioned cold drawing step. The amount of plastic deformation in the hot forging step and the cold forging step is not particularly limited as long as the average equivalent circle diameter of the austenite on the exposed surface of the personal ornament is 150 μm or less. The amount of plastic deformation in the hot forging step and the cold forging step is preferably selected so that the average equivalent circle diameter of the austenite on the exposed surface of the personal ornament is 70 μm or less. The hot forging step and the cold forging step increase the material yield as compared with the cold drawing step. Therefore, it is preferred to perform the hot forging step and the cold forging step by omitting the cold drawing step.

The method for producing a personal ornament according to the embodiment of the present invention described above may include a production step for making the personal ornament have predetermined shape and appearance. In the production step for making the personal ornament have predetermined shape and appearance, a known production method can be used.

Although not particularly limited, as an example, a method for producing a timepiece exterior will be shown. First, a method for producing a timepiece case among the timepiece exteriors will be described.

(Method for Producing Timepiece Case)

From a plate material or a bar material (hereinafter sometimes referred to as "material") subjected to the heat treatment step and the cold rolling step or the cold drawing step described above, a blank is punched out using a crank press machine and a punching die. The punched-out blank is molded into a near net shape using a plurality of molding dies. When the material is work hardened in the middle of the processing, an annealing step in which heating to a solution temperature or higher is performed, followed by quenching in a bright annealing furnace is appropriately performed.

Aside from the above description, a method for producing a blank adopting the hot forging step and the cold forging step will be described. First, the plate material or the bar material subjected to the above-mentioned heat treatment step is molded into a shape close to the above-mentioned punched-out blank through hot forging using a press machine and a plurality of heat-resistant dies by high-frequency induction heating or by heating in a heating furnace. After an oxide film on the surface is removed by pickling or sandblasting, a near net shape blank is produced by cold work using a press machine and a molding die. Process annealing may be performed as appropriate in the middle of the hot forging step and the cold forging step.

It is preferred to increase the number of dies in the cold forging step by decreasing the number of dies in the hot forging step. According to this, the average equivalent circle diameter of the austenite can be further decreased.

The pressed-up blank is subjected to a plurality of cutting and drilling steps such as grinding for the inner diameter to serve as a reference for processing with a numerical control (NC) lathe, a surface cutting for a press face, opening of a lug hole for attaching a band or a setting stem hole, and screw processing for attaching a case back, whereby an unpolished timepiece case is formed.

The unpolished timepiece case is subjected to rough polishing using a SALLAZ polishing machine equipped with water proof abrasive papers #360, #800, #1200, and #2000. Subsequently, the water proof abrasive paper is replaced with an abrasive cloth, and finish polishing is performed using alumina abrasives with a grain size of 3 μm, 1 μm, 0.3 μm, and 0.05 μm.

After the finish polishing, buffing for shine is performed. Depending on the design of the timepiece exterior, decoration such as scoring using a rotary wire brush, or honing (sandblasting) processing by applying a mask may be performed. Brazing or gluing of a setting stem pipe for attaching a crown is performed, whereby a case is completed. A case back or a bezel is also formed in the same process.

Subsequently, a method for producing a metal band among the timepiece exteriors will be described.

(Method for Producing Metal Band)

From a material subjected to the heat treatment step and the cold rolling step or the cold drawing step described above, a block is punched out using a press in the same manner as the timepiece case, and the block is molded into a shape close to a completed body using a molding press. Further, cutting of the surface, drilling of a pin hole for connecting the blocks, and polishing are performed. Finally, the blocks are connected in a predetermined sequence with a C-ring pin or the like, and a clasp to be used for attachment and detachment is attached.

Note that the method for producing a timepiece exterior is not limited to the methods described above, and any known production method to be carried out in the production of a timepiece exterior may be adopted.

Examples

Next, Examples of the present invention will be described. The conditions shown in Examples are an example adopted for confirming the feasibility and effects of the present invention. Therefore, the present invention is not limited to this example. The present invention can adopt various conditions as long as the object of the present invention is achieved without departing from the gist of the present invention.

(Heat Treatment Conditions)

Steel types A to D having the component composition shown in Table 1 were prepared. A steel type A having a plate thickness of 6 mm to 22 mm was subjected to a heat treatment under the conditions shown in Table 2, and the material was quenched after the heat treatment. With respect to the material after the heat treatment, the number of intermetallic compounds in which the size of the intermetallic compound is 150 μm or more, and intermetallic compounds in which the size thereof is 13 μm or more and less than 150 μm was measured.

A measurement method for the component composition of the material was as follows. As for an element other than N, first, a sample was collected from a portion at the ¼ plate thickness of the plate material. Thereafter, the component composition was measured according to JIS G 1256: 2013 (Iron and steel—Methods for X-ray fluorescence spectrometric analysis).

N was measured for the sample using JIS G 1228: 2006 (Iron and steel—Methods for determination of nitrogen content).

A measurement method for the number of intermetallic compounds in which the size is 150 μm or more, and intermetallic compounds in which the size is 13 μm or more and less than 150 μm was as follows. First, by using an optical microscope, a photograph of a structure of a central portion of the plate thickness was captured with a magnification of 10 times. In the captured photograph, the size of the intermetallic compound was measured. The size of the intermetallic compound is a diameter of a circle having a smallest area capable of including one intermetallic compound inside. Then, the number of intermetallic compounds in which the size is 150 μm or more, and intermetallic compounds in which the size is 13 μm or more and less than 150 μm was counted. In the plate material, the intermetallic compound with high Cr and Mo contents is present in the largest amount in the central portion of the plate thickness. Therefore, the number of intermetallic compounds measured by the above-mentioned method was assumed to be the number of intermetallic compounds in which the size is 150 μm or more, and the size is 13 μm or more and less than 150 μm. Further, the cold rolling step is performed at room temperature, and therefore, the number of intermetallic compounds in the material does not substantially change.

With respect to the intermetallic compounds in which the size is 150 μm or more, when the number thereof was 1, the measurement was finished. With respect to the intermetallic compounds in which the size is 13 μm or more and less than 150 μm, when the number thereof was 4, the measurement was finished. The measurement results of the number of intermetallic compounds in which the size is 13 μm or more and less than 150 μm are shown in Table 2. Note that in Table 2, in all the materials in which the number of intermetallic compounds in which the size is 13 μm or more and less than 150 μm was 0, the number of intermetallic compounds in which the size is 150 μm or more was also 0.

The measurement method for the area % of the austenite was as follows. First, it was performed using a scanning electron microscope-backscattered electron image (SEM-BSE). As for the measurement magnification, the measurement was performed with a magnification so that a square with a side of about 710 μm is included in the field of view, which is the same as a standard diagram described in JIS G 0555, Microscopic testing method for the non-metallic inclusions in steel (2003).

The measurement site was located at a position where the central portion of the plate thickness is parallel to one side (about 710 μm) of the square field of view and passes through the center of the square.

Subsequently, a captured backscattered electron image photograph was subjected to an image analysis and was classified into three stages of luminance pixels: an intermetallic compound (high-luminance pixel), austenite (intermediate-luminance pixel), and a non-intermetallic compound (low-luminance pixel). The percentage of the number of pixels of the austenite with respect to the total number of pixels was determined to be the area % of the austenite. Further, the cold rolling step is performed at room temperature, and therefore, the area % of the austenite in the material does not substantially change. Therefore, the area % of the austenite in the material after the heat treatment step was assumed to be the area % of the austenite of the personal ornament. The measurement results of the area % of the austenite are shown in Table 3.

TABLE 1

| Steel | Chemical components (mass%) | | | | | | | | | |
|---|---|---|---|---|---|---|---|---|---|---|
| type | C | Si | Mn | P | S | Ni | Cr | Mo | N | PRE |
| A | 0.015 | 0.50 | 0.95 | 0.020 | 0.004 | 18.0 | 20.2 | 6.2 | 0.022 | 41 |
| B | 0.015 | 0.50 | 0.95 | 0.020 | 0.004 | 18.0 | 21.0 | 6.2 | 0.022 | 42 |
| C | 0.02 | 0.06 | 0.60 | 0.020 | 0.004 | 16.0 | 22.0 | 4.5 | 0.058 | 38 |
| D | 0.02 | 0.06 | 1.00 | 0.020 | 0.004 | 10.5 | 16.0 | 2.2 | — | 23 |

TABLE 2

| Plate thickness | Temperature (K) | | | | | | | | | | | |
|---|---|---|---|---|---|---|---|---|---|---|---|---|
| | 1473 | | | 1523 | | | | | | 1548 | | |
| | Heat treatment time (h) | | | | | | | | | | | |
| (mm) | 1 | 10 | 40 | 2 | 4 | 8 | 10 | 12 | 18 | 1 | 10 | 40 |
| 6 | 4 or more | 4 or more | 0 | 4 or more | 4 or more | 0 | 0 | 0 | 0 | 4 or more | 0 | 0 |
| 8 | — | 4 or more | 0 | — | 4 or more | 0 | 0 | 0 | 0 | 4 or more | 0 | 0 |
| 10 | — | 4 or more | 0 | — | — | 4 or more | 4 or more | 4 or more | 0 | — | 4 or more | 0 |
| 12 | — | — | 4 or more | — | — | — | — | — | 4 or more | — | — | 0 |
| 22 | — | — | 4 or more | — | — | — | — | — | 4 or more | — | — | 4 or more |

TABLE 3

| Plate thickness (mm) | Temperature (K) | | | | | | |
|---|---|---|---|---|---|---|---|
| | 1473 | 1523 | | | | 1548 | |
| | Heat treatment time (h) | | | | | | |
| | 40 | 8 | 10 | 12 | 18 | 10 | 40 |
| 6 | 95 or more | 95 or more | 95 or more | 95 or more | 95 or more | 95 or more | 95 or more |
| 8 | 95 or more | 95 or more | 95 or more | 95 or more | 95 or more | 95 or more | 95 or more |
| 10 | 95 or more | — | — | — | 95 or more | — | 95 or more |
| 12 | — | — | — | — | — | — | 95 or more |
| 22 | — | — | — | — | — | — | - |

As shown in Table 2 and Table 3, when the heat treatment conditions in the heat treatment step satisfy the following formula (2), the area % of the austenite and the number of intermetallic compounds in which the size is 150 μm or more, and intermetallic compounds in which the size is 13 μm or more and less than 150 μm was within the range of the present invention. The area % of the austenite was 95% or more in all the conditions. Further, the remainder of the structure was a non-metallic phase.

$$t_{dif} \geq (6869/T_{dif} - 4.3326) \times \lambda^2 \quad (2)$$

Note that in the formula (2), $T_{dif}$ represents the heat treatment temperature (K), $t_{dif}$ represents the heat treatment time (hour), and λ represents a plate thickness (mm) of the plate material.

(Cold Rolling Conditions)

A plate material of steel type A having a thickness of 6 mm was subjected to a heat treatment at 1473 K for 12 hours. After the heat treatment, cold rolling was performed to a predetermined thickness using a two-stage rolling mill. A rolling reduction amount per pass was set to 0.10 mm, and the rolling was finished after the predetermined thickness was obtained. The rolling reduction ratio in the cold rolling is shown in Table 4.

The rolled material was cut out at a plane perpendicular to the rolling direction. With respect to the cut-out material, a blank was punched out using a crank press machine and a punching die. The punched-out blank was molded into a near net shape using a plurality of molding dies.

The pressed-up blank was subjected to grinding for the inner diameter to serve as a reference for processing with a numerical control (NC) lathe, a surface cutting for a press face, opening of a sharp hole or a lug hole for attaching a band, screw processing for attaching a case back, and a plurality of cutting and drilling steps, whereby an unpolished timepiece case was obtained.

The unpolished timepiece case was subjected to rough polishing using a SALLAZ polishing machine equipped with water proof abrasive papers #360, #800, #1200, and #2000. Subsequently, the water proof abrasive paper was replaced with an abrasive cloth, and finish polishing was performed using alumina abrasives with a grain size of 3 μm, 1 μm, 0.3 μm, and 0.05 μm. After the finish polishing, buffing for shine was performed.

As a result, timepiece cases of Examples 1 to 6 and Comparative Examples 1 to 4 were obtained. The hardness of the material immediately after cold rolling was measured. In the measurement of the hardness, a Vickers hardness meter was used. A load in the hardness measurement was set to 0.3 kgf, and the retention time was set to 15 seconds. The measurement results obtained using the Vickers hardness meter are shown in Table 4.

The average equivalent circle diameter of the austenite crystal grains was determined as follows. An azimuth of an individual crystal grain was determined using an electron backscatter diffraction device (EBSD device) attached to a field-emission type SEM. A site where an azimuth difference between adjacent pixels is 5° or more was defined as a crystal grain boundary. Further, the actual area of a crystal grain was measured, and the average equivalent circle diameter of the austenite was calculated from the formula for determining the area of a circle. Note that processing in which an annealing twin present in a crystal grain is not determined to be the grain boundary was performed. The measurement results of the average equivalent circle diameter of the austenite are shown in Table 4.

With respect to the timepiece cases, specularity was measured by performing appearance determination. The specularity was evaluated in three grades: poor, average, and good. The measurement results of the specularity are shown in Table 4.

TABLE 4

| | Rolling reduction ratio (%) | Vickers hardness (HV 0.3) | Specularity | Average equivalent circle diameter of austenite (μm) |
|---|---|---|---|---|
| Example 1 | 7.0 | 210 | average | 149 |
| Example 2 | 9.9 | 230 | average | 124 |
| Example 3 | 12.5 | 235 | average | 107 |
| Example 4 | 15.2 | 247 | good | 70 |
| Example 5 | 21.1 | 283 | good | 62 |
| Example 6 | 31.5 | 309 | good | — |
| Comparative Example 1 | 0 | 176 | poor | 217 |
| Comparative Example 2 | 2.3 | 185 | poor | 203 |
| Comparative Example 3 | 5.0 | 202 | poor | 165 |
| Comparative Example 4 | 51.1 | 364 | good | — |

In Examples 1 to 6, the heat treatment conditions in the heat treatment step and the rolling reduction ratio in the cold rolling were within the range of the present invention, and therefore, the material was not excessively hardened. Therefore, the material had sufficient workability even after the cold rolling step. Further, the average equivalent circle diameter of the austenite did not become excessively large, and therefore, the timepiece cases had sufficient specularity.

On the other hand, in Comparative Examples 1 to 3, the rolling reduction ratio in the cold rolling was insufficient, and therefore, the specularity of the timepiece cases was insufficient. Further, in Comparative Example 4, the rolling reduction ratio in the cold rolling was excessively high, and therefore, the workability of the material after the cold rolling step was insufficient.

(Corrosion Resistance)

In Example 7, a test piece for a corrosion resistance test was prepared as follows. A plate material of steel type B having a thickness of 2 mm was subjected to a heat treatment at 1473 K for 1.5 hours. After the heat treatment, the plate material was quenched. Thereafter, the plate material was subjected to cold rolling at a rolling reduction ratio of 25%. The thickness of the plate material after the cold rolling was 1.5 mm. The plate material after the cold rolling was cut out into a rectangular shape with a height of 20 mm and a width of 40 mm. The corners were chamfered, and thereafter, the rolled faces (two faces) and the cut side faces (four faces) were mirror-finished by performing the same polishing step as in the method for producing a timepiece case in Example 1.

In Comparative Examples 5 to 7, a heat treatment and cold rolling were not performed. Test pieces for a corrosion resistance test were prepared in the same manner as in Example 7 except for this.

The corrosion resistance test was performed as follows. With respect to 10 sheets of the mirror-finished rectangular test pieces, a half-immersion test in a saturated saline solution at 60° C. was performed. Specifically, a saturated saline solution in a state of coexistence with solid sodium chloride was placed in a container, and the test piece was set on a rack made of polytetrafluoroethylene capable of being leaned at an inclination of 30° from a vertical direction, and sunk in the container. Thereafter, the amount of the liquid was adjusted so that the test piece was in a state where it was dipped to a height of 10 mm in the sodium chloride solution. The container was left to stand in a thermoregulated bath at 60° C. The test piece was periodically taken out, and after washing, the occurrence state of pitting or intergranular corrosion was confirmed using a stereoscopic microscope. The half immersion test was performed for 1000 hours at the longest. The average time until the occurrence of corrosion in 10 sheets of the test pieces was determined to be a corrosion time. Note that the corrosion time of the test piece which was not corroded until 1000 hours was determined to be 1000 hours. The results of the corrosion resistance test are shown in Table 5.

TABLE 5

| | Steel type | PRE | Corrosion time (h) |
|---|---|---|---|
| Example 7 | B | 42 | 808 or more |
| Comparative Example 5 | B | 42 | 768 or more |
| Comparative Example 6 | C | 38 | 275 |
| Comparative Example 7 | D | 23 | 23 |

In Example 7, the heat treatment conditions and the PRE were within the range of the present invention, and therefore, favorable corrosion resistance was exhibited.

In Comparative Example 5, the heat treatment conditions were outside the range of the present invention, and therefore, the corrosion resistance was lower than in Example 7. In Comparative Example 6 and Comparative Example 7, the heat treatment conditions and the PRE were outside the range of the present invention, and therefore, the corrosion resistance was insufficient.

(When Performing Cold Forging Step and Hot Forging Step)

A test was also performed when the hot forging step and the cold forging step are performed by omitting the cold rolling step and the cold drawing step.

In Example 8, a round bar of steel type A having an average circle diameter of 25 mm was used. The round bar was subjected to a heat treatment at 1523 K for 8 hours in an argon atmosphere. After the heat treatment, the round bar was quenched with pressurized nitrogen gas. The round bar subjected to the heat treatment was cut to a length of about 40 mm, thereby forming a billet. The billet was hot-forged into a shape close to a blank by heating the billet to 1473 K using a high-frequency induction heating method, and punching out the billet using a plurality of heat-resistant forging dies. After the hot forging, an oxide film on the surface was removed by sandblasting or pickling, and then, cold forging was performed. Thereafter, a timepiece case was obtained by the same steps as in Examples 1 to 7.

In Example 9, a plate material of steel type A having a plate thickness of 14 mm and a width of 40 mm was used. The heat treatment conditions of Example 9 were set to a heat treatment at 1523 K for 36 hours. The plate material subjected to the heat treatment was cut to a length of about 35 mm. Thereafter, a timepiece case was obtained under the same conditions as in Example 8.

The average equivalent circle diameter of the austenite and specularity of Examples 8 and 9 were measured in the same manner as in Examples 1 to 7. As a result, the average equivalent circle diameters of the austenite of Examples 8 and 9 are both 150 μm or less, and also the specularity was sufficient.

Thus, according to the present invention, a personal ornament having excellent corrosion resistance and specularity and a method for producing the personal ornament can be provided, and the utilization value in industry is high.

What is claimed is:

1. A personal ornament wherein chemical components include, in mass %:

C: 0.10% or less;
Si: 1.5% or less;
Mn: 1.5% or less;
P: 0.050% or less;
S: 0.050% or less;
O: 0.020% or less;
Ni: 15.0 to 38.0%;
Cr: 17.0 to 27.0%;
Mo: 4.0 to 8.0%;
Cu: 3.0% or less; and
N: 0.55% or less,
the remainder includes Fe and impurities,
a structure contains austenite at 95% or more in area %,
when a diameter of a circle having a smallest area capable of including one intermetallic compound inside is defined as a size of the intermetallic compound, on an exposed surface of the personal ornament, the number of intermetallic compounds in which the size is 150 μm or more is 0, and the number of intermetallic compounds in which the size is 13 μm or more and less than 150 μm is 3 or less,
an average equivalent circle diameter of the austenite is 150 μm or less, and
a PRE defined by the following formula (1) is 40 or more:

$$PRE=[Cr]+3.3[Mo]+16[N] \quad (1)$$

wherein [Cr], [Mo], and [N] denote the contents in mass % of Cr, Mo, and N in a component composition of the personal ornament, and 0 is substituted when such a component is not contained.

2. The personal ornament according to claim 1, wherein the chemical components further include, in mass %, one type or two or more types selected from:

Al: 0.001 to 0.10%;
Co: 0.001 to 3.0%;
W: 0.001 to 8.0%;
Ta: 0.001 to 1.0%;
Sn: 0.001 to 1.0%;
Sb: 0.001 to 1.0%;
Ga: 0.001 to 1.0%;
Ti: 0.001 to 1.0%;
V: 0.001 to 1.0%;
Nb: 0.001 to 1.0%;
Zr: 0.001 to 1.0%;
Te: 0.001 to 1.0%;
Se: 0.001 to 1.0%;
B: 0.0001 to 0.01%;
Ca: 0.0001 to 0.05%;
Mg: 0.0001 to 0.05%; and
a rare earth element: 0.001 to 1.0%.

3. The personal ornament according to claim 1, wherein the personal ornament is a timepiece exterior.

* * * * *